US008656516B1

(12) United States Patent
Reinhardt Rawlings et al.

(10) Patent No.: US 8,656,516 B1
(45) Date of Patent: Feb. 25, 2014

(54) CHILDREN'S CLOTHING WITH HIDDEN HARNESS AND EXTERIOR HANDHOLDS

(71) Applicants: Megan Nichole Reinhardt Rawlings, Dallas, TX (US); Charles Parker Reinhardt, Jr., Fayetteville, AR (US)

(72) Inventors: Megan Nichole Reinhardt Rawlings, Dallas, TX (US); Charles Parker Reinhardt, Jr., Fayetteville, AR (US)

( * ) Notice: Subject to any disclaimer, the term of this patent is extended or adjusted under 35 U.S.C. 154(b) by 0 days.

(21) Appl. No.: 13/660,256

(22) Filed: Oct. 25, 2012

(51) Int. Cl.
*A41D 1/00* (2006.01)

(52) U.S. Cl.
USPC ..... 2/80; 2/69

(58) Field of Classification Search
USPC ..... 2/69, 80, 69.5, 94, 75, 271, 1, 93, 111, 2/247, 311
See application file for complete search history.

(56) References Cited

U.S. PATENT DOCUMENTS

| | | | | | |
|---|---|---|---|---|---|
| 602,861 | A * | 4/1898 | Lyon | 119/770 |
| 1,050,934 | A * | 1/1913 | Fanta | 2/113 |
| 1,651,561 | A * | 12/1927 | Storey | 119/770 |
| 1,805,766 | A * | 5/1931 | Groves | 2/111 |
| 2,067,870 | A * | 1/1937 | Blackwell | 2/78.2 |
| 2,568,304 | A * | 9/1951 | Schoenbrun | 119/770 |
| 2,623,678 | A * | 12/1952 | Law | 297/465 |
| 3,997,921 | A * | 12/1976 | Knight | 2/75 |
| 4,304,006 | A | 12/1981 | Swart | |
| 4,449,253 | A * | 5/1984 | Hettinger | 2/93 |
| 4,599,750 | A | 7/1986 | Rahaman | |
| 4,639,946 | A | 2/1987 | Koenig | |
| 5,259,338 | A | 11/1993 | Cornell | |
| 5,369,804 | A * | 12/1994 | Metcalf | 2/69 |
| 5,542,123 | A * | 8/1996 | DiPietro | 2/80 |
| 6,167,572 | B1 * | 1/2001 | Naumovitz | 2/227 |
| 6,230,329 | B1 * | 5/2001 | Jennings | 2/114 |
| 6,378,465 | B1 * | 4/2002 | Austin | 119/770 |
| RE38,393 | E | 1/2004 | Bronson | |
| 6,836,902 | B2 * | 1/2005 | Marquez et al. | 2/69 |
| 7,225,472 | B2 * | 6/2007 | McDonald et al. | 2/102 |
| 7,571,494 | B2 * | 8/2009 | Grilliot et al. | 2/69 |
| 7,574,750 | B2 * | 8/2009 | Harris | 2/80 |
| 7,707,660 | B2 * | 5/2010 | Grilliot et al. | 2/455 |
| 7,818,818 | B2 * | 10/2010 | Grilliot et al. | 2/94 |
| 8,430,204 | B1 * | 4/2013 | Reynolds | 182/3 |
| 8,522,364 | B2 * | 9/2013 | O'Brien | 2/227 |
| 2002/0042942 | A1 * | 4/2002 | Colorado | 2/230 |
| 2004/0133963 | A1 * | 7/2004 | Jennings | 2/114 |
| 2009/0144876 | A1 * | 6/2009 | Pena et al. | 2/102 |

* cited by examiner

*Primary Examiner* — Danny Worrell
(74) *Attorney, Agent, or Firm* — Amanda K. Jenkins; Colin P. Cahoon; Carstens & Cahoon, LLP

(57) ABSTRACT

An article of clothing for children with a hidden harness attached to the interior of the clothing structure and exterior handholds attached to the hidden harness. When a handhold is pulled, the force is spread over the entire hidden harness allowing the force of the grasp to be evenly distributed across the child's frame. The handholds also provide a place of attachment for an extension tether strap. The clothing structure used may be a full body garment, upper body garment, lower body garment or infant garment.

16 Claims, 15 Drawing Sheets

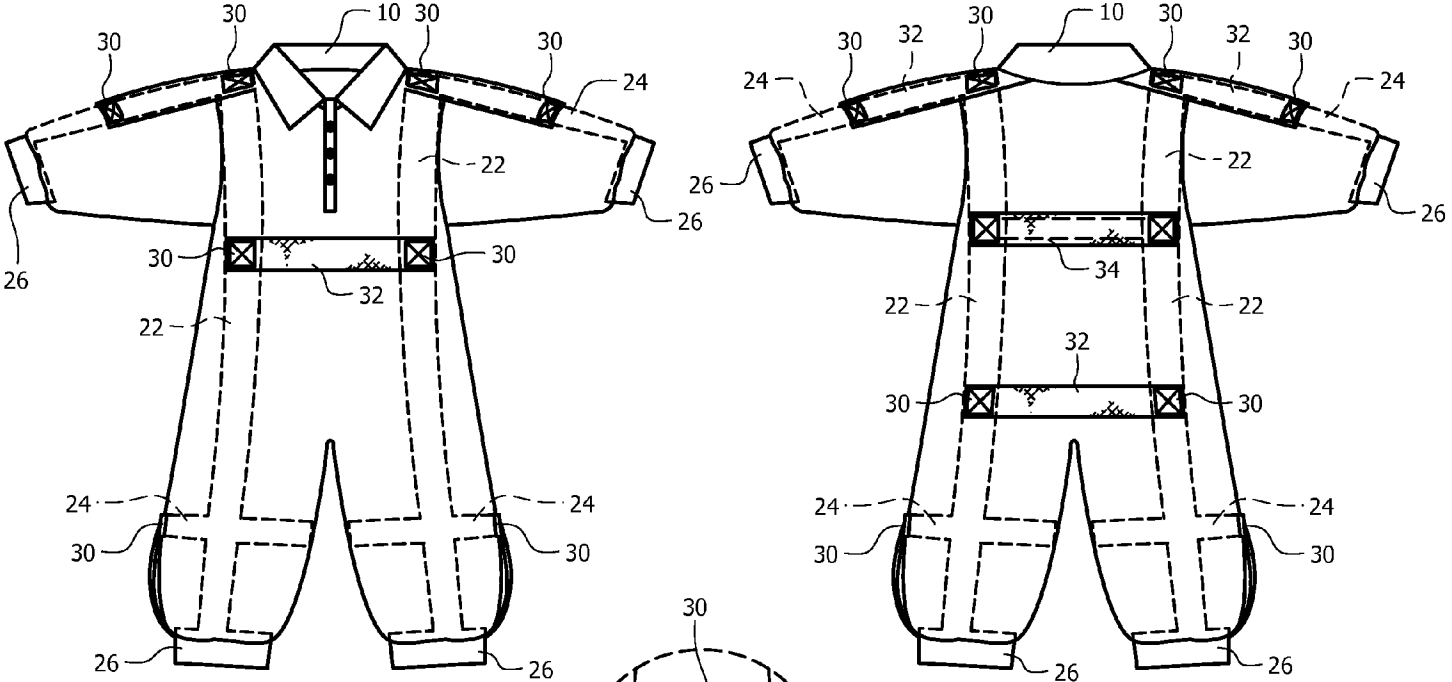
FIG. 1A
FIG. 1B
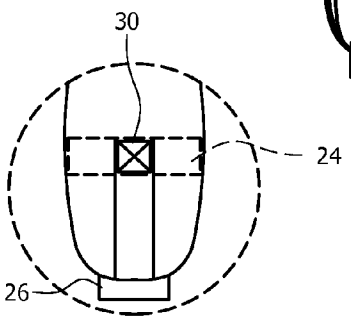
FIG. 1C

CHILDREN'S CLOTHING WITH HIDDEN HARNESS AND EXTERIOR HANDHOLDS

BACKGROUND OF THE INVENTION

1. Technical Field

The present invention relates to children's clothing with a hidden harness and exterior handholds for parents to hold and more safely grasp their child.

2. Description of Related Art

In the past, infant and toddler apparel has generally only focused on clothing children and the fashion taste of parents. Some apparel has incorporated handles on the exterior of children's clothing to allow parents to more easily grasp their children. However, when grasped, these handles concentrate the force exerted on the area of the body on which the handle is attached. Consequently, there is a need for children's clothing with exterior handles that distributes the force exerted on the handle evenly across the child's body, allowing a parent to grasp their child more safely.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

FIG. 1A is a front view of one embodiment of the invention;

FIG. 1B is a back view of one embodiment of the invention;

FIG. 1C is a partial side view of one embodiment of the invention;

DETAILED DESCRIPTION OF THE INVENTION

Figure 2B:
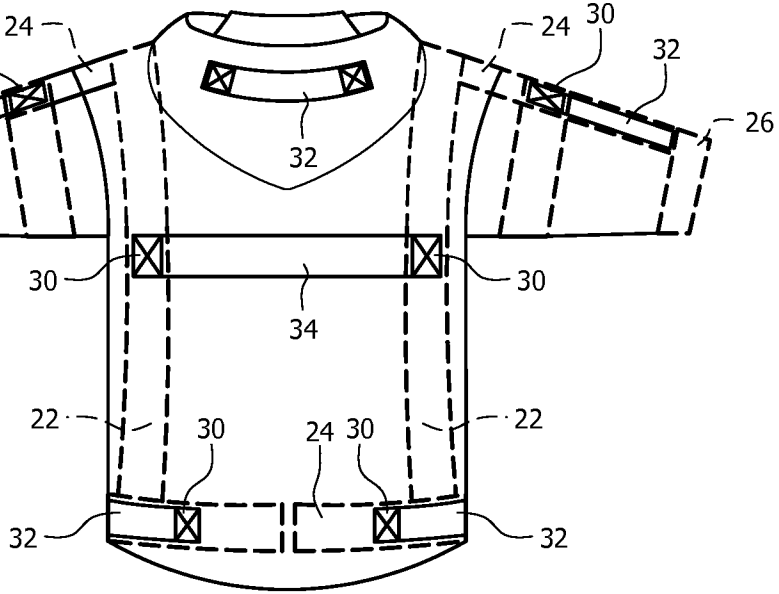
FIG. 2B is a back view of one embodiment of the invention.

Several embodiments of Applicants' invention will now be described with reference to the drawings. Unless otherwise noted, like elements will be identified by identical numbers throughout all figures. The invention illustratively disclosed herein suitably may be practiced in the absence of any element which is not specifically disclosed herein.

The invention described herein is directed to clothing for infants and toddlers with a built-in, hidden harness and strategically placed exterior handholds that give parents a place to get a good grasp on their children. The handholds are reinforced straps attached to the hidden harness within the clothing. Until needed, the handholds blend into the design of the clothing. When used, the handholds allow the force of the parent's grasp to be more evenly distributed across the child's frame due to the hidden harness. Thus, the present invention provides a healthier way for parents to grab or hold on to their children to prevent a fall or keep the child close. The handholds also provide a place of attachment for an extension tether strap, which allows parents to have the functionality of a regular harness without the look or feel of a leash.

For the purposes of description, the inventive clothing can be divided into four types—full body pieces, upper body pieces, lower body pieces and infant pieces. Each piece has a hidden harness within the clothing structure and exterior handholds attached to the hidden harness. Each piece will be described in turn.

In one embodiment, the clothing structure is a full body article of clothing, like that shown in FIGS. 1A and 1B, with a torso portion, a left shoulder portion, a right shoulder portion, a neck portion between the left and right shoulder portions, a left leg portion and a right leg portion. Each of the left and right leg portions has an opening at its end terminal from the torso portion, and all portions have an anterior side and posterior side. In one embodiment, the full body article of clothing also has a left sleeve portion and a right sleeve portion, each with an opening at its end terminal from the shoulder portions. Examples of full body articles of clothing are a jumper, overalls or onesie. FIGS. 1A and 1B depict the front and back views of a full body piece. A hidden harness 20 is attached to the interior of the clothing structure 10 by sewing or any other means known in the art. The hidden harness 20 is formed by two main vertical straps 22 that extend the entire length of the clothing structure in the anterior and posterior, at least three horizontal support straps 24 attached to the main vertical straps, and at least two terminal support straps 26 attached to the main vertical straps.

A left main vertical strap 22 extends from the opening of the anterior left leg portion upward along the anterior torso portion, over the left shoulder portion, and downward along the posterior torso portion to the opening of the posterior left leg portion. A right main vertical strap 22 extends from the opening of the anterior right leg portion upward along the anterior torso portion, over the right shoulder portion, and downward along the posterior torso portion to the opening of the posterior right leg portion. A first horizontal support strap 24 extends across the upper posterior torso portion of the clothing structure 10 from the left main vertical strap 22 to the right main vertical strap 22 and is attached to the left and right main vertical straps 22. Each leg portion of the clothing structure 10 has a horizontal support strap 24 encircling the leg portion about two inches below where the child's knee would be located. A left leg horizontal strap 24 encircles the left leg portion and is attached to the left main vertical strap 22 where the left leg horizontal strap 24 intersects with the left main vertical strap 22 in the anterior and posterior of the left leg portion. A right leg horizontal strap 24 encircles the right leg portion and is attached to the right main vertical strap 22 where the right leg horizontal strap 24 intersects with the right main vertical strap 22 in the anterior and posterior of the right leg portion. In one embodiment, there are also horizontal support straps 24 across the upper anterior torso portion, lower posterior torso portion or lower anterior torso portion, which attach to the left and right main vertical straps 22. Each leg portion has a terminal support strap 26 encircling its opening. A left leg terminal support strap 26 encircles the opening of the left leg portion and is attached to the left main vertical strap 22 where the left leg terminal support strap 26 intersects the left main vertical strap 22 in the anterior and posterior of the left leg portion. A right leg terminal support strap 26 encircles the opening of the right leg portion and is attached to the right main vertical strap 22 where the left leg terminal support strap 26 intersects the right main vertical strap 22 in the anterior and posterior of the right leg portion.

In clothing structures having sleeve portions, each sleeve portion contains a horizontal support strap 24. A left sleeve horizontal support strap 24 extends from the left main vertical strap 22 down the sleeve portion to the opening of the left sleeve portion of the clothing structure 10. A right sleeve horizontal support strap 24 extends from the right main vertical strap 22 down the sleeve portion to the opening of the right sleeve portion. Each sleeve portion has a terminal support strap 26 encircling its opening. A left sleeve terminal support strap 26 encircles the opening of the left sleeve portion and is attached to the left sleeve horizontal support strap 24. A right sleeve terminal support strap 26 encircles the opening of the right sleeve portion and is attached to the right sleeve horizontal support strap 24.

In one embodiment, the full body article of clothing has exterior handholds 32 across the upper anterior torso portion from the left main vertical strap 22 to the right main vertical strap 22 and across the lower posterior torso portion from the left main vertical strap 22 to the right main vertical strap 22. A tether attachment exterior handhold 34 extends across the upper posterior torso portion of the clothing structure 10 from the left main vertical strap 22 to the right main vertical strap 22. As shown in FIG. 1C, a left leg exterior handhold 32 extends along the lateral left leg portion from the left leg horizontal support strap 24 to the left leg terminal support strap 26. A right leg exterior handhold 32 extends along the lateral right leg portion from the right leg horizontal support strap 24 to the right leg terminal support strap 26. In clothing structures having sleeves, a left sleeve exterior handhold 32 extends along the lateral left sleeve portion from the left main vertical strap 22 in the left shoulder portion down to a point on the left horizontal support strap 24. A right sleeve exterior handhold 32 extends along the lateral right sleeve portion from the left main vertical strap 22 in the right shoulder portion down to a point on the right horizontal support strap 24. Each terminal of the exterior handholds 32, 34 are attached to the hidden harness 20 through the clothing structure 10 where the exterior handholds 32, 34 intersect the components of the hidden harness 20 at attachment points 30. Other possible placements for exterior handholds will be described in more detail below.

Figure 2A:
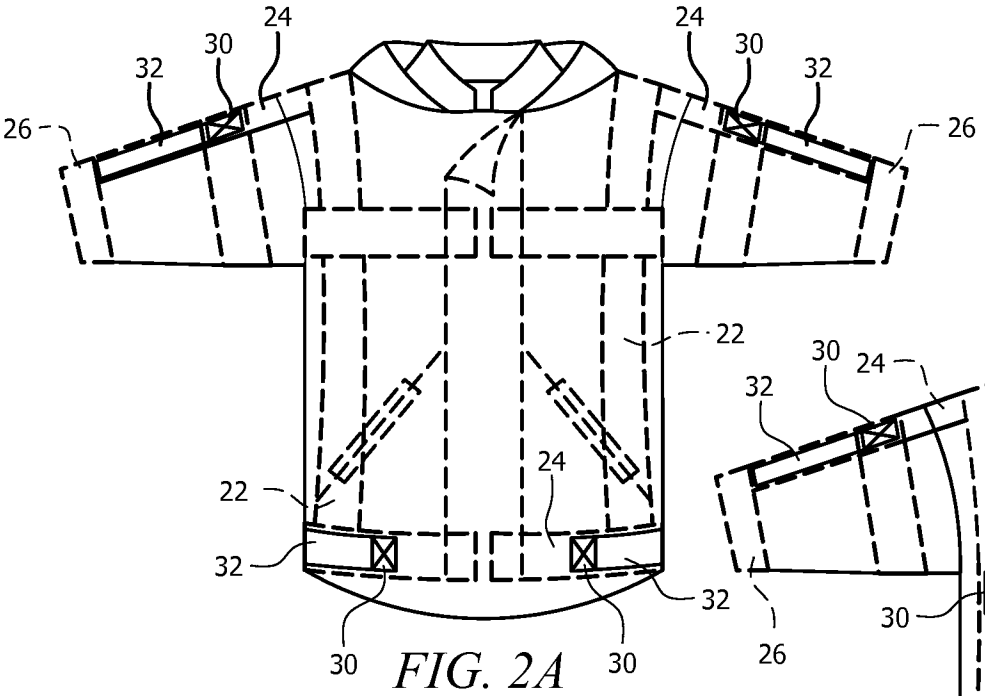
FIG. 2A is a front view of one embodiment of the invention.

In one embodiment, the clothing structure is an upper body article of clothing, like that in FIGS. 2A and 2B, such as a shirt or jacket, with a torso portion terminating in a lower hem, a left shoulder portion, a right shoulder portion, a neck portion between the left and right shoulder portions, a left sleeve portion and a right sleeve portion. Each sleeve portion has an opening at its end terminal from the shoulder portions, and all portions have an anterior side and a posterior side. FIGS. 2A and 2B depicts the front and back views of an upper body piece. A hidden harness 20 is attached to the interior of the clothing structure 10 by sewing or any other means known in the art. The hidden harness 20 is formed by two main vertical straps 22 that extend the entire length of the clothing structure in the anterior and posterior, at least three horizontal support straps 24 attached to the main vertical straps, and at least two terminal support straps 26 attached to the horizontal support straps.

A left main vertical strap 22 extends from the lower hem on the left side of the anterior torso portion upward along the anterior torso portion, over the left shoulder portion, and downward along the posterior torso portion to the lower hem on the left side of the posterior torso portion. A right main vertical strap 22 extends from the lower hem on the right side of the anterior torso portion upward along the anterior torso portion, over the right shoulder portion, and downward along the posterior torso portion to the lower hem on the right side of the posterior torso portion. A first horizontal support strap 24 extends across the upper posterior torso portion of the clothing structure 10 from the left main vertical strap 22 to the right main vertical strap 22. A second horizontal support strap 24 stretches around the lower hem of the torso portion and is attached to the left and right main vertical straps 22 where it intersects the left and right main vertical straps 22 in the anterior and posterior. In one embodiment, there is also a horizontal support strap 24 across the lower posterior torso portion. A left sleeve horizontal support strap 24 extends from the left main vertical strap 22 down the sleeve portion to the opening of the left sleeve portion of the clothing structure 10. A right sleeve horizontal support strap 24 extends from the right main vertical strap 22 down the sleeve portion to the opening of the right sleeve portion. Each sleeve portion has a terminal support strap 26 encircling its opening. A left sleeve terminal support strap 26 encircles the opening of the left sleeve portion and is attached to the left sleeve horizontal support strap 24. A right sleeve terminal support strap 26 encircles the opening of the right sleeve portion and is attached to the right sleeve horizontal support strap 24.

In one embodiment, the upper body article of clothing has exterior handholds 32 extending laterally around each side of the torso portion from a point on the anterior lower hem to a point on the posterior lower hem. A left sleeve exterior handhold 32 extends along the lateral left sleeve portion from the left main vertical strap 22 in the left shoulder portion down to a point on the left horizontal support strap 24. A right sleeve exterior handhold 32 extends along the lateral right sleeve portion from the right main vertical strap 22 in the right shoulder portion down to a point on the right horizontal support strap 24. A tether attachment exterior handhold 34 extends across the upper posterior torso portion of the clothing structure 10 from the left main vertical strap 22 to the right main vertical strap 22. Each terminal of the exterior handholds 32, 34 are attached to the hidden harness 20 through the clothing structure 10 where the exterior handholds 32, 34 intersect the components of the hidden harness 20 at attachment points 30. Other possible placements for exterior handholds will be described in more detail below.

Figure 3B:
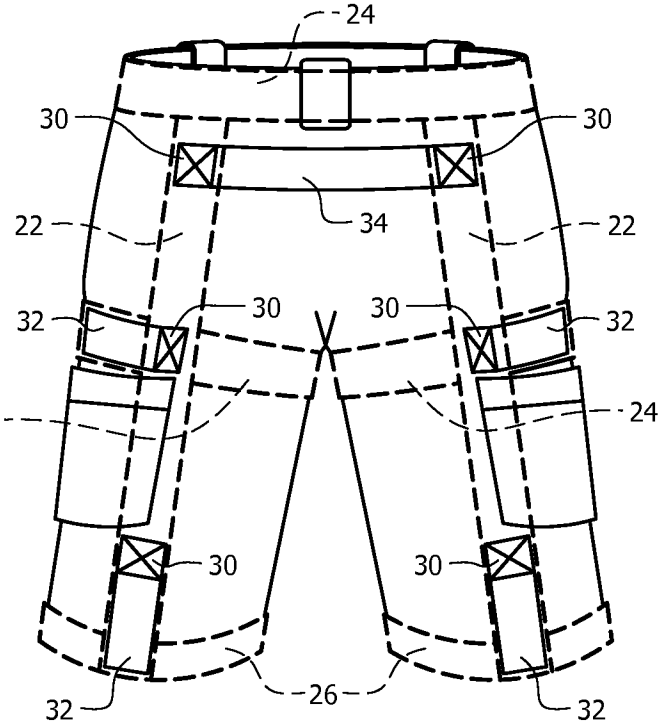
FIG. 3B is a back view of one embodiment of the invention.
Figure 3A:
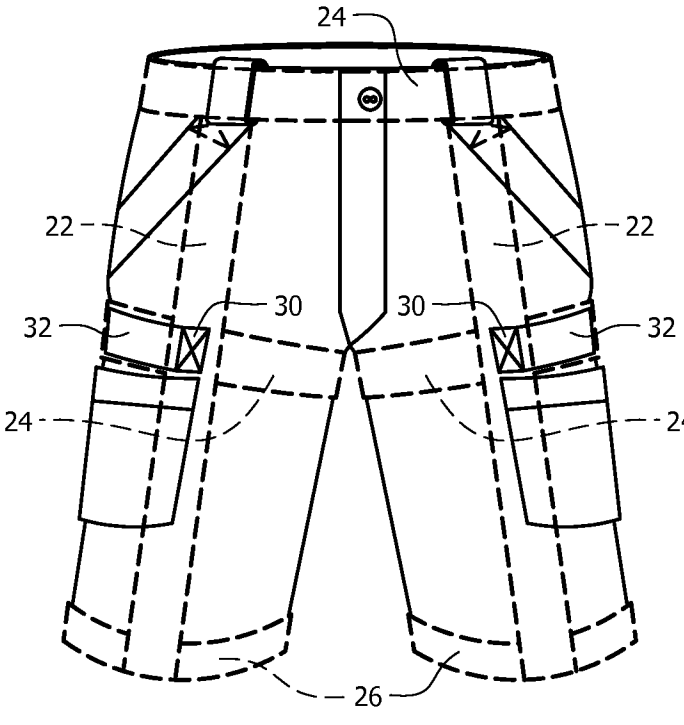
FIG. 3A is a front view of one embodiment of the invention.

In one embodiment, the clothing structure is a lower body article of clothing, like that in FIGS. 3A and 3B, such as pants or shorts, having a torso portion terminating in an upper hem, a left leg portion and a right leg portion. Each of the left and right leg portions has an opening at its end terminal from the torso portion, and all portions have an anterior side and posterior side. FIGS. 3A and 3B depicts the front and back views of a lower body piece. A hidden harness 20 is attached to the interior of the clothing structure 10 by sewing or any other means known in the art. The hidden harness 20 is formed by four main vertical straps 22, two in the anterior and two in the posterior, that extend the length of the clothing structure 10, at least three horizontal support straps 24 attached to the main vertical straps 22, and two terminal support straps 26 attached to the main vertical straps 22.

An anterior left main vertical strap 22 extends from the upper hem of the anterior left torso portion downward to the opening of the anterior left leg portion of the clothing structure 10, and an anterior right main vertical strap 22 extends from the upper hem of the anterior right torso portion downward to the opening of the anterior right leg portion. A posterior left main vertical strap 22 extends from the upper hem of the posterior left torso portion downward to the opening of the posterior left leg portion of the clothing structure 10, and a posterior right main vertical strap 22 extends from the upper hem of the posterior right torso portion downward to the opening of the posterior right leg portion. A first horizontal support strap 24 extends around the upper hem of the torso portion, reinforcing the natural waistline of the garment, and is attached to the upper terminals of the anterior left, anterior right, posterior left and posterior right main vertical support straps 22 where they intersect. Each leg portion of the clothing structure 10 has a horizontal support strap 24 encircling the leg portion about two inches below where the child's knee would be located. A left leg horizontal strap 24 encircles the left leg portion and is attached to the anterior left and posterior left main vertical straps 22 where the left leg horizontal strap 24 intersects with the anterior left and posterior left main vertical straps 22. A right leg horizontal strap 24 encircles the right leg portion and is attached to the anterior right and posterior right main vertical straps 22 where the right leg horizontal strap 24 intersects with the anterior right and posterior right main vertical straps 22. Each leg portion has a terminal support strap 26 encircling its opening. A left leg terminal support strap 26 encircles the opening of the left leg portion and is attached to the anterior left and posterior left main vertical straps 22 where the left leg terminal support strap 26 intersects the anterior left and posterior left main vertical straps 22. A right leg terminal support strap 26 encircles the opening of the right leg portion and is attached to the anterior right and posterior right main vertical straps 22 where the left leg terminal support strap 26 intersects the anterior right and posterior right main vertical straps 22.

In one embodiment, the lower body article of clothing has five exterior handholds 32. A left leg transitional exterior handhold 32 extends along the lateral left leg portion from the anterior left main vertical support strap 22 to said posterior left main vertical support strap 22 and a right leg transitional exterior handhold 32 extends along the lateral right leg portion from the anterior left main vertical support strap 22 to said posterior left main vertical support strap 22. A left leg posterior external handhold 32 extends from a point on the posterior left main vertical strap 22 to the left leg terminal support strap 22 and a right leg posterior external handhold 32 extends from a point on the posterior right main vertical strap 22 to the right leg terminal support strap 22. A tether attachment handhold 34 extends across the upper posterior torso portion of the clothing structure 10 from the posterior left main vertical strap 22 to the posterior right main vertical strap 22. Each terminal of the exterior handholds 32, 34 are attached to the hidden harness 20 through the clothing structure 10 where the exterior handholds 32, 34 intersect the components of the hidden harness 20 at attachment points 30. Other possible placements for exterior handholds will be described in more detail below.

Figure 4B:
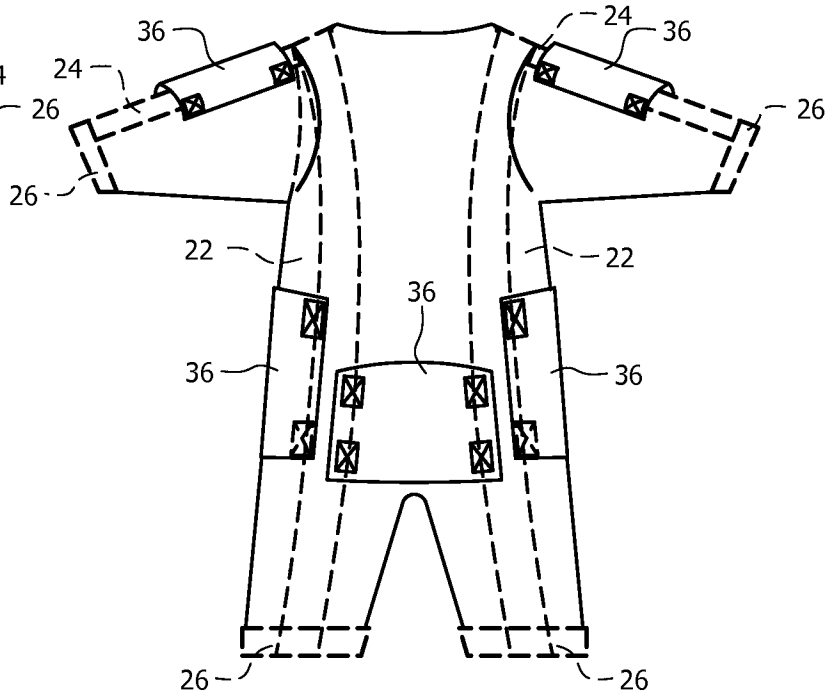
FIG. 4B is a back view of one embodiment of the invention.
Figure 4A:
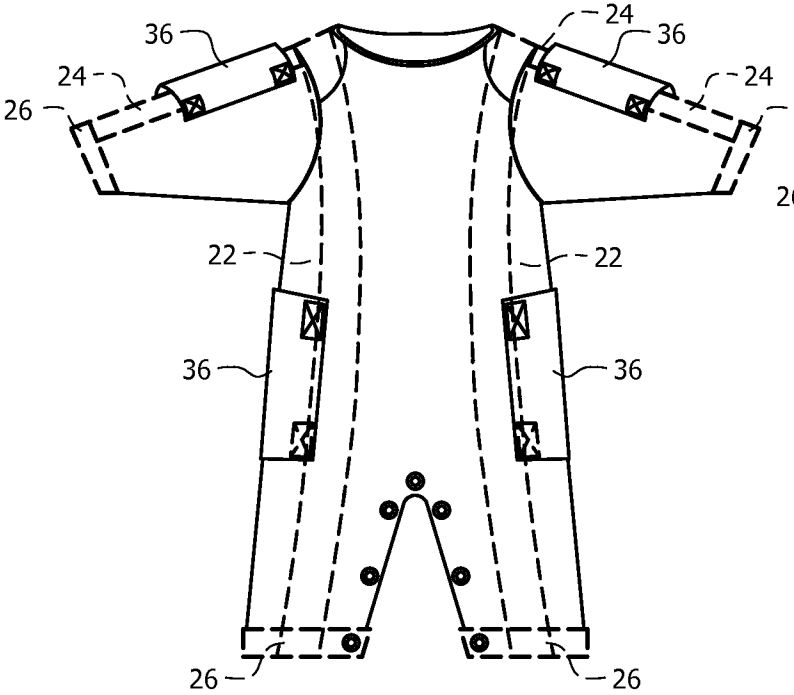
FIG. 4A is a front view of one embodiment of the invention.

In one embodiment, the clothing structure is an article of clothing for infants, like that shown in FIGS. 4A and 4B, similar to the full body pieces described above, having a torso portion, a left shoulder portion, a right shoulder portion, a neck portion between the left and right shoulder portions, a left leg portion, a right leg portion, a left sleeve portion and a right sleeve portion. The left and right leg portions each have an opening at its end terminal from the torso portion, and each of the left and right sleeve portions has an opening at its end terminal from the shoulder portions. All portions have an anterior side and posterior side. FIGS. 4A and 4B depicts the front and back views of an infant piece. A hidden harness 20 is attached to the interior of the clothing structure 10 by sewing or any other means known in the art. The hidden harness 20 is formed by two main vertical straps 22 that extend the entire length of the clothing structure in the anterior and posterior, at least two horizontal support straps 24 attached to the main vertical straps, and four terminal support straps 26 attached to the main vertical straps or horizontal support straps.

A left main vertical strap 22 extends from the opening of the anterior left leg portion upward along the anterior torso portion, over the left shoulder portion, and downward along the posterior torso portion to the opening of the posterior left leg portion. A right main vertical strap 22 extends from the opening of the anterior right leg portion upward along the anterior torso portion, over the right shoulder portion, and downward along the posterior torso portion to the opening of the posterior right leg portion. A left sleeve horizontal support strap 24 extends from the left main vertical strap 22 down the sleeve portion to the opening of the left sleeve portion of the clothing structure 10. A right sleeve horizontal support strap 24 extends from the right main vertical strap 22 down the sleeve portion to the opening of the right sleeve portion. In one embodiment, a horizontal support strap 24 extends across the upper posterior torso portion of the clothing structure 10 from the left main vertical strap 22 to the right main vertical strap 22, across the upper anterior torso portion from the left main vertical strap 22 to the right main vertical strap 22, lower posterior torso portion from the left main vertical strap 22 to the right main vertical strap 22 or lower anterior torso portion from the left main vertical strap 22 to the right main vertical strap 22. A left leg terminal support strap 26 encircles the opening of the left leg portion and is attached to the left main vertical strap 22 where the left leg terminal support strap 26 intersects the left main vertical strap 22 in the anterior and posterior of the left leg portion. A right leg terminal support strap 26 encircles the opening of the right leg portion and is attached to the right main vertical strap 22 where the right leg terminal support strap 26 intersects the right main vertical strap 22 in the anterior and posterior of the right leg portion. A left sleeve terminal support strap 26 encircles the opening of the left sleeve portion and is attached to the left sleeve horizontal support strap 24. A right sleeve terminal support strap 26 encircles the opening of the right sleeve portion and is attached to the right sleeve horizontal support strap 24.

In one embodiment, the infant article of clothing has exterior handholds 36 across the lower posterior torso portion from the left main vertical strap 22 to the right main vertical strap 22, along the outside of the leg portions extending from the anterior left main vertical strap 22 to the posterior left main vertical strap 22 and from the anterior right main vertical strap 22 to the posterior right main vertical strap 22, and along left sleeve and right sleeve horizontal support straps 24. The infant exterior handholds 36 are generally wider than the exterior handholds 32, 34 to allow an entire hand to be inserted between the clothing structure and handhold. Each terminal of the exterior handholds 32, 34 are attached to the hidden harness 20 through the clothing structure 10 where the exterior handholds 32, 34 intersect the components of the hidden harness 20 at attachment points 30. Other possible placements for exterior handholds will be described in more detail below.

In all clothing types, the straps of the hidden harness 20 are sewn together to make a single harness that is attached to the interior of the clothing structure. In a preferred embodiment, the harness 20 is sewn to the interior of the clothing structure 10 by a weight-bearing stitch, which allows the stitching to hold under the weight of a child when a force is exerted on the harness. As used herein, "weight-bearing stitch" means a reinforced side-by-side, standard hem or row stitch. A protective lining may optionally be attached to the clothing structure 10 over the hidden harness 20 to fully enclose the harness within fabric.

All clothing types have at least four exterior handholds. Each handhold is attached to the hidden harness by stitching or any other means known in the art. The handholds are attached such that when one is pulled on, the force is spread over the entire hidden harness, distributing the force across the entire body of the child instead of centralizing the force at the point of the pull. The handholds are strategically placed to allow a parent to easily grasp their children. While Applicant describes several possible placement positions for the handholds, one skilled in the art will be able to determine the number of handholds required, what combinations of handhold positions are preferred for each type of clothing and other possible placement positions.

Figure 5B:
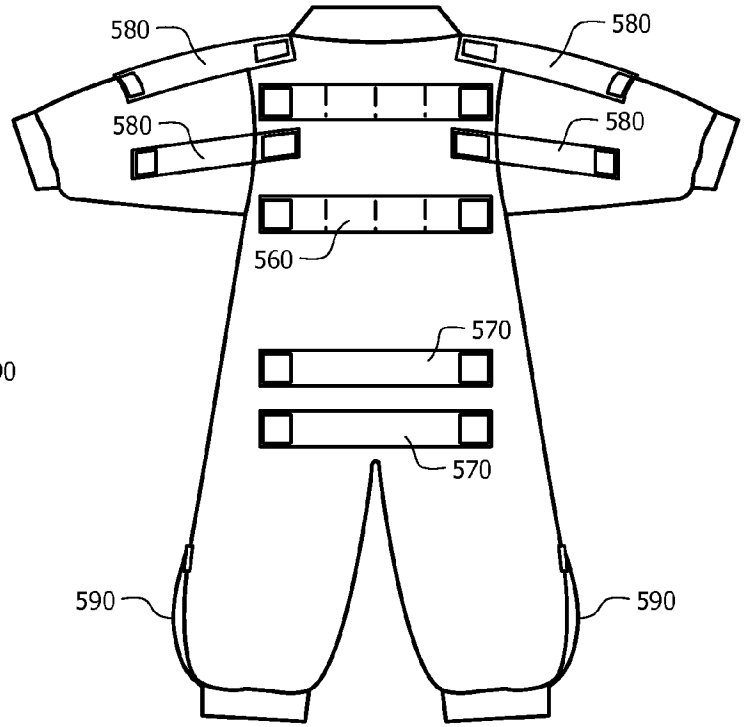
FIGS. 5B & 6B are back views showing possible handhold placements.
Figure 5A:
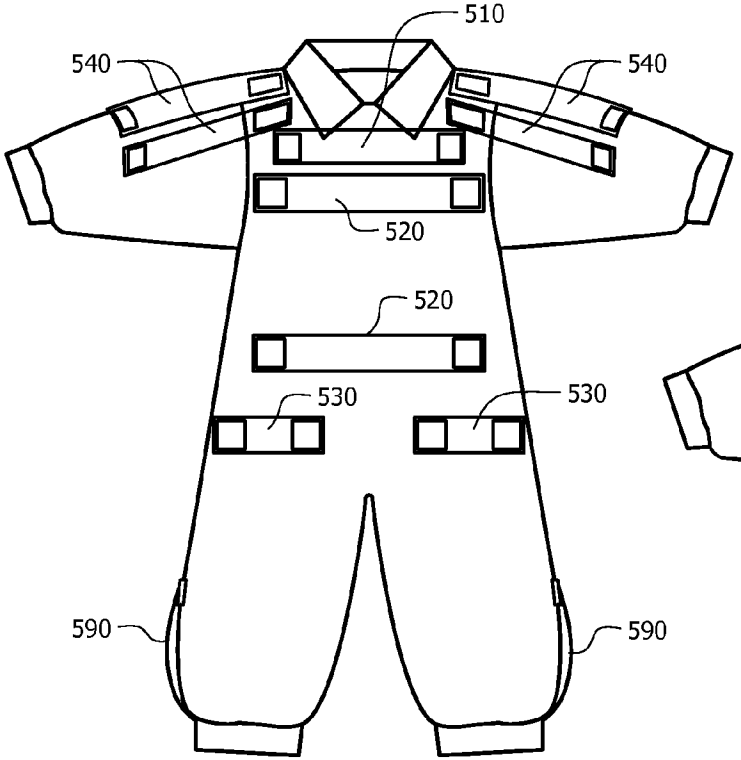
FIGS. 5A & 6A are front views showing possible handhold placements.

Referring to FIG. 5A, the superior anterior torso handhold 510 originates on or between the sleeve/torso (armscye) seam and garment midline (center front seam) on one side of the clothing structure and inserts on or between the sleeve/torso (armscye) seam and garment midline (center front seam) on the other side of the clothing structure at any point between the sleeve pit (armscye) and superior torso (shoulder) seam. The superior anterior torso handhold 510 may be arranged horizontally or vertically, unilaterally or bilaterally, involve one or both halves of the torso in relation to the midline (center seam), and be in singular or multiple arrangements. The anterior torso handhold 520 originates on or between the garment waist and superior torso (shoulder) seam on one side of the clothing structure and inserts on or between the superior torso (shoulder) seam and garment waist on the other side of the clothing structure. The anterior torso handhold 520 may be arranged horizontally or vertically at any point between the lateral torso seam (side back seams), in singular or multiple arrangements. The inferior anterior torso handhold 530 originates on or between the lateral torso (side back) seam and garment midline (center front seam) on one side of the clothing structure and inserts on or between the lateral torso (side back) seam and garment midline (center front seam) on the other side of the clothing structure at any point between the garment crotch and sleeve/torso (armscye) seam. The inferior anterior torso handhold 530 may be arranged horizontally or vertically, unilaterally or bilaterally, involve one or both halves of the torso in relation to the midline (center seam), and be in singular or multiple arrangements. The anterior sleeve vertical handhold 540 originates on or between the sleeve cuff and sleeve/torso (armscye) seam on one sleeve of the clothing structure and inserts on or between the sleeve/torso (armscye) seam and sleeve cuff on the same sleeve of the clothing structure. The anterior sleeve vertical handhold 540 may be arranged vertically at any point between the lateral sleeve and sleeve inseam, in singular or multiple arrangements.

Referring now to FIG. 5B, the superior posterior torso handhold 550 originates on or between the sleeve/torso (armscye) seam and garment midline (center front seam) on one side of the clothing structure and inserts on or between the sleeve/torso (armscye) seam and garment midline (center front seam) on the other side of the clothing structure at any point between the sleeve pit (armscye) and superior torso (shoulder) seam. The superior posterior torso handhold 550 may be arranged horizontally or vertically, unilaterally or bilaterally, involve one or both halves of the torso in relation to the midline (center seam), and be in singular or multiple arrangements. The posterior torso handhold 560 originates on or between the garment waist and superior torso (shoulder) seam on one side of the clothing structure and inserts on or between the superior torso (shoulder) seam and garment waist on the other side of the clothing structure. The posterior torso handhold 560 may be arranged horizontally or vertically at any point between the lateral torso seam (side back seams), in singular or multiple arrangements. The inferior posterior torso handhold 570 originates on or between the lateral torso (side back) seam and garment midline (center front seam) on one side of the clothing structure and inserts on or between the lateral torso (side back) seam and garment midline (center front seam) on the other side of the clothing structure at any point between the garment crotch and sleeve/torso (armscye) seam. The inferior posterior torso handhold 570 may be arranged horizontally or vertically, unilaterally or bilaterally, involve one or both halves of the torso in relation to the midline (center seam), and be in singular or multiple arrangements. The posterior sleeve vertical handhold 580 originates on or between the sleeve cuff and sleeve/torso (armscye) seam on one sleeve of the clothing structure and inserts on or between the sleeve/torso (armscye) seam and sleeve cuff on the same sleeve of the clothing structure. The posterior sleeve vertical handhold 580 may be arranged vertically at any point between the lateral sleeve and sleeve inseam, in singular or multiple arrangements. The lateral leg vertical handhold 590 originates on the lateral (outer) seam on one leg of the clothing structure and inserts on the inferior lateral (lower outer) seam on the same leg, arranged vertically.

Figure 6B:
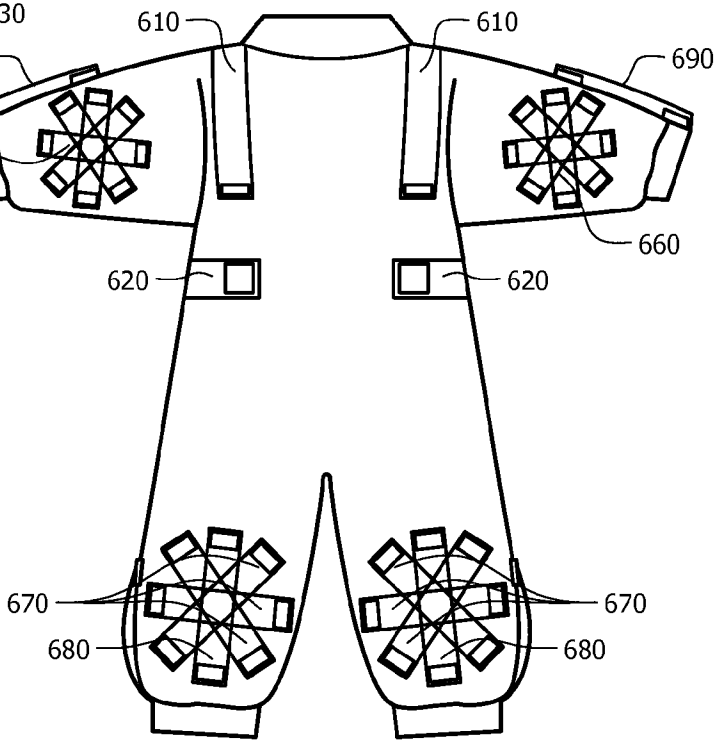
Figure 6A:
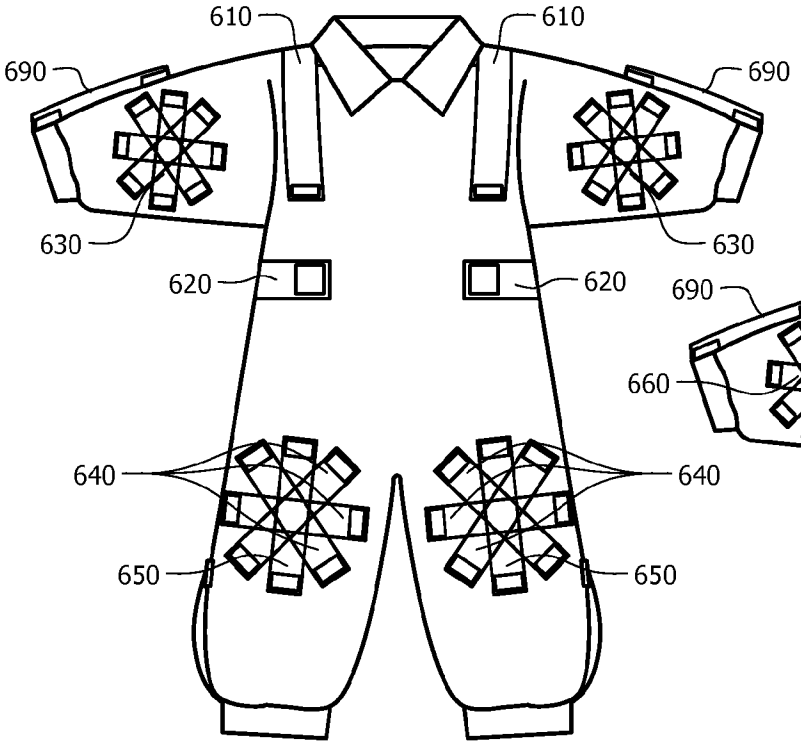

Referring to FIGS. 6A and 6B, the superior torso transitional handhold 610 originates on or between the anterior waist and shoulder seam, crosses the shoulder seam and inserts on or between the posterior waist and shoulder seam. The superior torso transitional handhold 610 may be arranged vertically or diagonally, crossing anteriorly or posteriorly, in singular or multiple arrangements. The lateral torso transitional handhold 620 originates on or between the anterior midline (center front) seam and lateral (side back) seam, crosses lateral (side back) seam and inserts on or between the posterior midline (center front) seam and lateral (side back) seam. The lateral torso transitional handhold 620 may be arranged unilaterally without crossing anterior or posterior (center front or center back) seams, arranged horizontally or diagonally, in singular or multiple arrangements.

Referring to FIG. 6A, the anterior sleeve horizontal/diagonal handhold 630 originates on or between the sleeve inseam and lateral sleeve on one sleeve of the clothing structure and inserts on or between the lateral sleeve and sleeve inseam on the same sleeve of the clothing structure, arranged horizontally or diagonally at any point between sleeve cuff seam and sleeve/torso (armscye) seam, in singular or multiple arrangements. The anterior leg horizontal/diagonal handhold 640 originates on or between the leg inseam and lateral (outer) seam on one leg of the clothing structure and inserts on or between the lateral (outer) seam and leg inseam on the same leg of the clothing structure, arranged horizontally or diagonally at any point between garment crotch and leg cuff seam, in singular or multiple arrangements. The anterior leg vertical handhold 650 originates on or between the waist and leg cuff seam on one leg of the clothing structure and inserts on or between the leg cuff seam and waist on the same leg of the clothing structure, arranged horizontally or diagonally at any point between garment crotch and leg cuff seam, in singular or multiple arrangements.

Referring to FIG. 6B, the posterior sleeve horizontal/diagonal handhold 660 originates on or between the sleeve inseam and lateral sleeve on one sleeve of the clothing structure and inserts on or between the lateral sleeve and sleeve inseam on the same sleeve of the clothing structure, arranged horizontally or diagonally at any point between sleeve cuff seam and sleeve/torso (armscye) seam, in singular or multiple arrangements. The posterior leg horizontal/diagonal handhold 670 originates on or between the leg inseam and lateral (outer) seam on one leg of the clothing structure and inserts on or between the lateral (outer) seam and leg inseam on the same leg of the clothing structure, arranged horizontally or diagonally at any point between garment crotch and leg cuff seam, in singular or multiple arrangements. The posterior leg vertical handhold 680 originates on or between the waist and leg cuff seam on one leg of the clothing structure and inserts on or between the leg cuff seam and waist on the same leg of the clothing structure, arranged horizontally or diagonally at any point between garment crotch and leg cuff seam, in singular or multiple arrangements. The lateral sleeve vertical handhold 690 originates on the lateral (outer) seam on one sleeve of the clothing structure and inserts on the inferior lateral (lower outer) seam on the same sleeve, arranged vertically.

Figure 7A:
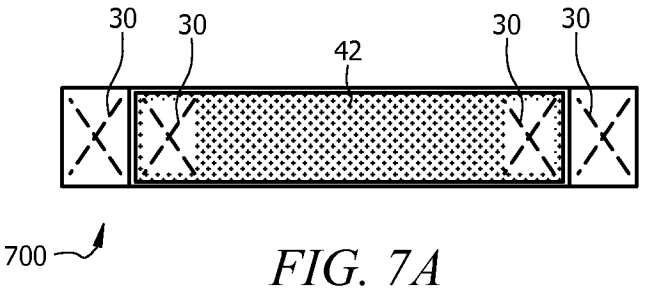
FIGS. 7A, 8A, 9A & 10A are top views of embodiments of unexpanded handholds.
Figure 7B:
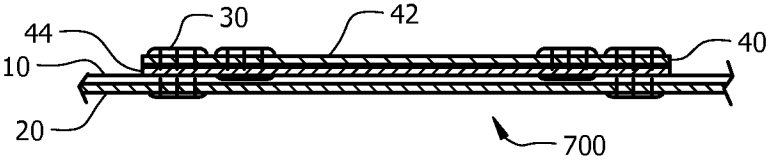
FIGS. 7B, 8B, 9B & 10B are side views of embodiments of unexpanded handholds.
Figure 7C:
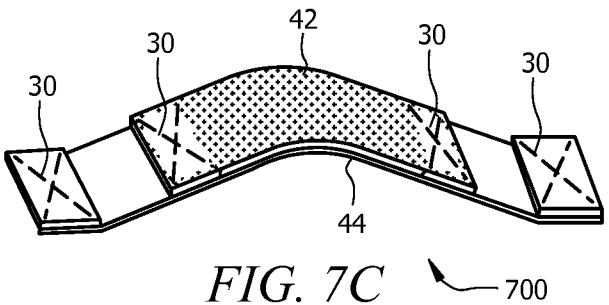
FIGS. 7C, 8C & 9C are top elevational views of embodiments of expanded handholds.
Figure 7D:
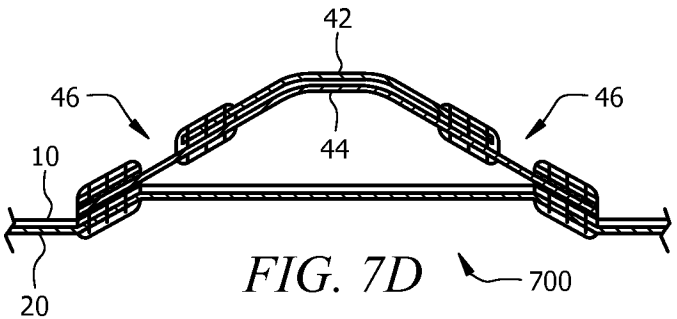
FIGS. 7D, 8D & 9D are side views of embodiments of expanded handholds.

The handholds are constructed of pieces of rigid fabric and flexible fabric such that when the handhold is pulled, the flexible fabric allows the handhold to extend away from the clothing structure in the direction of the force. One embodiment, shown in FIGS. 7A-7D, is the four-piece flat handhold 700. The four-piece flat handhold 700 is constructed of two short pieces of rigid fabric 40, one longer piece of rigid fabric 42 and one piece of elastic fabric 44. The top layer of the handhold 700 is formed of one short piece of rigid fabric 40 (end piece), the longer piece of rigid fabric 42 and one piece of rigid fabric 40. The bottom layer of the handhold 700 is the elastic piece 44, which is a single piece that runs the full length the three rigid pieces. The separate pieces of the handhold 700 are assembled as shown in FIG. 7B and attached to the clothing with stitching. The short rigid end pieces 40 are sewn through the ends of the elastic piece 44 through the clothing structure 10 and through the harness 20 at the attachment points 30. The ends and the center of the longer rigid piece 42 are sewn through the elastic piece 44 while the flexible material 44 is slightly extended. The longer rigid piece 42 is not sewn through the clothing structure 10 or the hidden harness 20. This allows the flexible material to extend and absorb some of the force of the pull when the handhold 700 is pulled, as shown in FIG. 7D. The lengths of the four pieces will differ depending on the type of clothing as the distance between the attachment points 30 to the harness 20 vary from garment to garment.

Figure 8A:
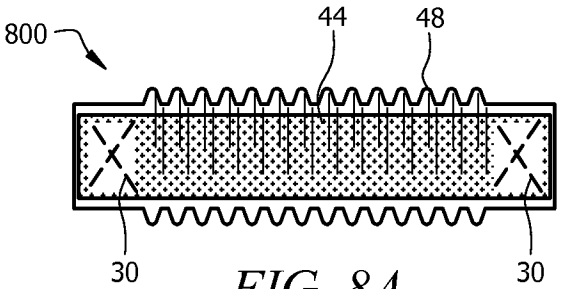
Figure 8B:
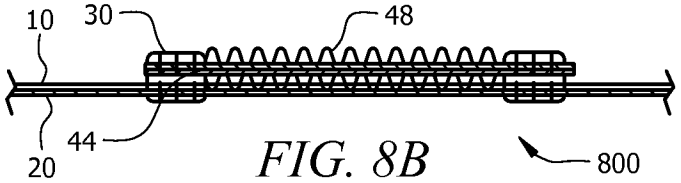
Figure 8C:
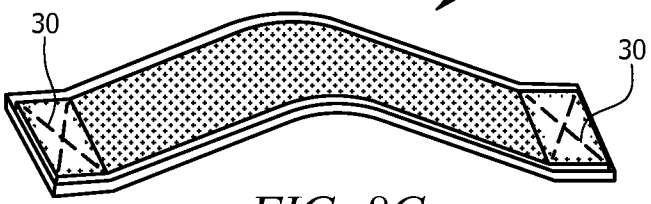
Figure 8D:
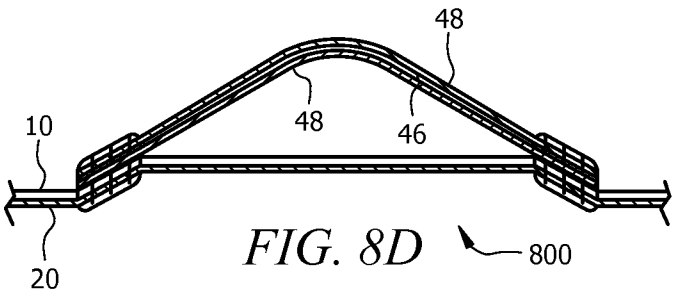
Figure 9B:
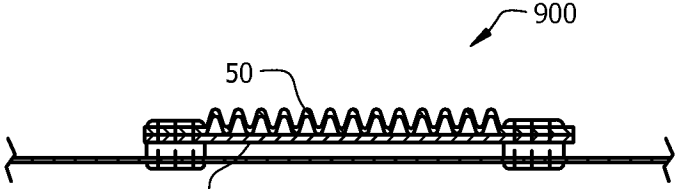
Figure 9D:
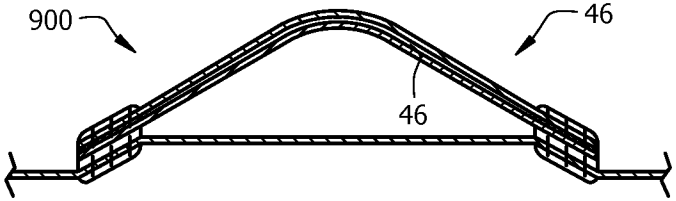
Figure 9A:
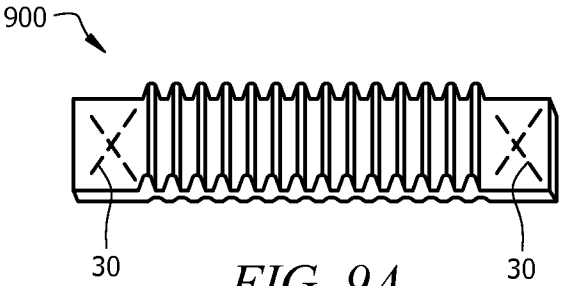
Figure 9C:
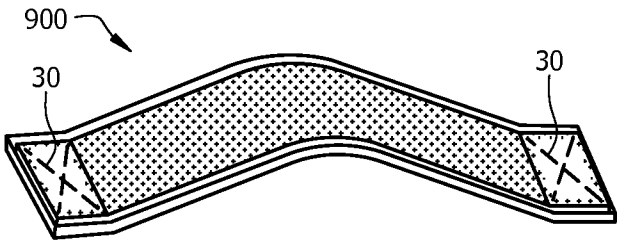

Another embodiment of the handhold is depicted in FIGS. 8A-8D. The two-piece tube-encased handhold 800 is constructed of one rigid fabric encasement 48 and one length of flexible material 44. The pieces of rigid and flexible materials are equal in length in their resting state. The rigid encasement 48 is a folded piece of rigid fabric sewn with a double stitch to create a tubular enclosure. The flexible material 44 is threaded through the rigid encasement 48 and the encasement 48 is gathered to allow for the flexible material 44 to expand during the in-use state. The ends of the handhold 800 are secured at the attachment points 30 with reinforced stitching that penetrates all layers of the garment—the handhold 800, the clothing structure 10 and the hidden harness 20. When this type of handhold is in use, as shown in FIG. 8D, the flexible material 44 will expand to the limit of the rigid fabrics gather—absorbing some of the energy of the force of the pull.

Another embodiment of the handhold is depicted in FIGS. 9A-9D. The two-piece gather sewn handhold 900 is constructed of a single, double, or triple ply of rigid fabric 50 and one piece of flexible material 44. The rigid fabric 50 is presewn or tacked in place over the flexible material 44 while the flexible material is extended. They are sewn together at least five points or continuously over the length of both pieces. As the flexible material 44 contracts from its expanded state, the rigid material 50 gathers. Each end of the contracted, finished handhold 900 is sewn through the clothing structure 10 and the hidden harness 20. It may be necessary to sew on the handhold 900 with some tension taken up in the handhold 900 so that it lays flush to the clothing surface.

Figure 10B:
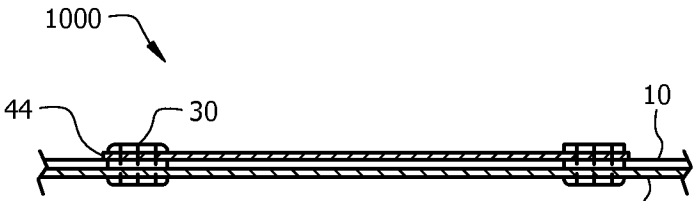
Figure 10A:
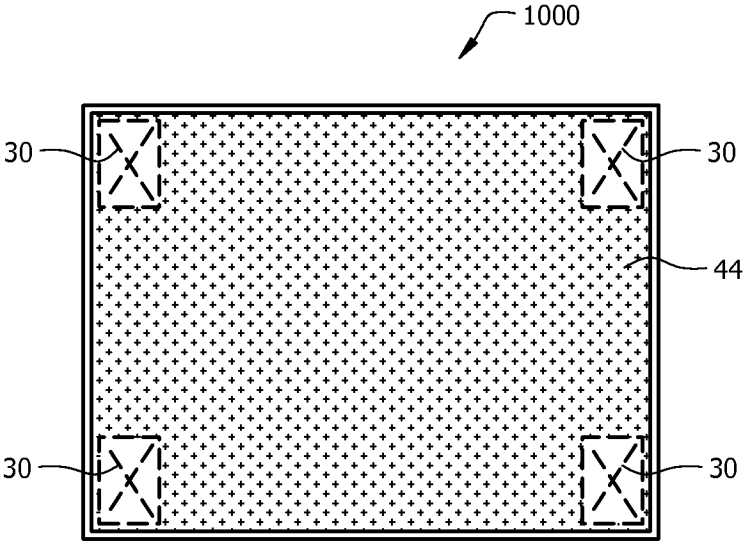

The infant handhold, which generally has a greater width to allow a full hand to slip between the handhold and the clothing structure in order to provide more support while holding the infant, is depicted in FIGS. 10A and 10B. The infant handhold 1000 is constructed of two to five layers of flexible fabric 44. The layers of flexible fabric 44 are sewn together as a unit and then attached to the clothing structure 10 at each corner. The corners are sewn to penetrate the clothing structure 10 and the hidden harness 20. Each side of the handhold 1000 is unattached to the clothing structure so a hand can move between the handhold 1000 and the clothing structure 10 for a more secure hold.

Figure 11A:
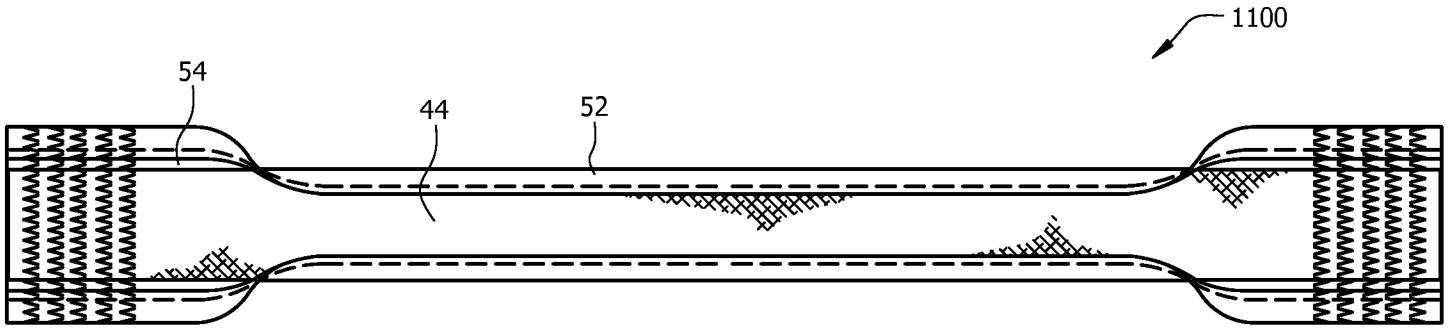
FIGS. 11A, 12A, 13A, 14A & 15A are top views of embodiments of handholds.
Figure 11B:
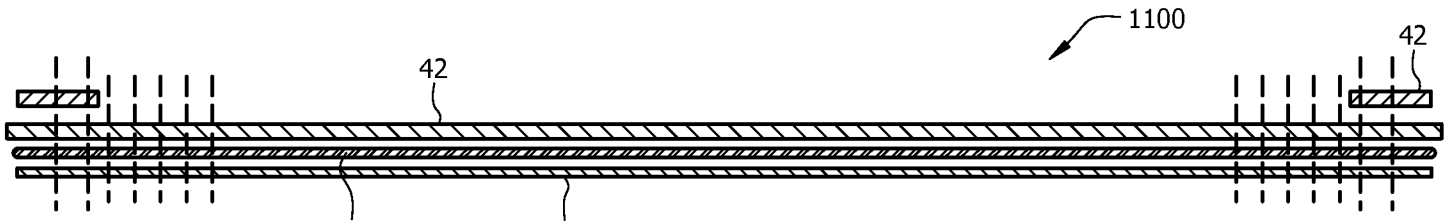
FIGS. 11B, 12B, 13B, 14B & 15B are side views of embodiments of unexpanded handholds.

Another embodiment of the handhold is depicted in FIGS. 11A-11B. The side wrap handhold 1100 is constructed of one piece of a flexible material 44, a second piece of a flexible material 54, a piece of rigid material 42 and a piece of a flexible binding material 52. The flexible materials 44, 54 are layered on top of the flexible binding material 52. The edges of the flexible binding material 52 are wrapped around the sides of the layered flexible materials 44, 54, as shown in FIG. 11A, and sewn or tacked along the length of the materials. The flexible materials 44, 54 may be sewn together prior to the flexible binding material 52 being wrapped around its edges or they may remain unattached. The assembled handhold 1100 is then attached to the garment by sewing both ends of the handhold 1100 with stitches that penetrate through the clothing structure 10 and the hidden harness 20.

Figure 12A:
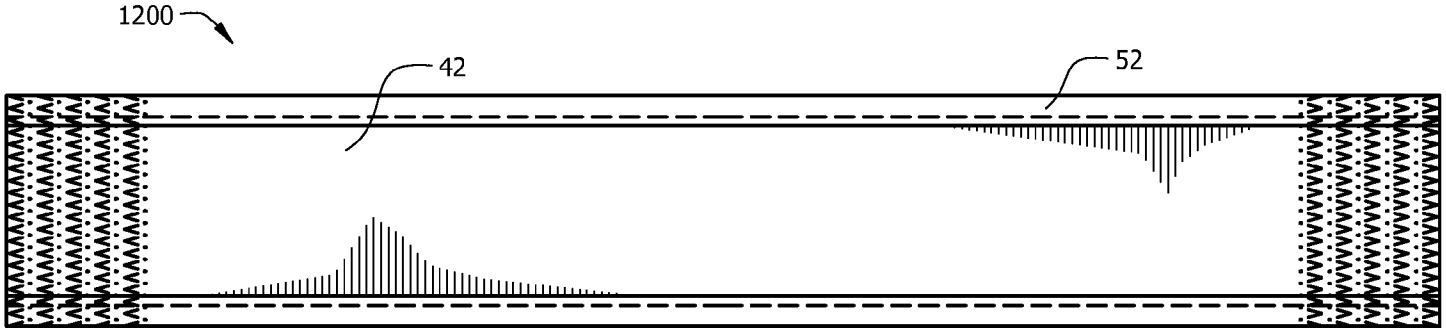
Figure 12B:
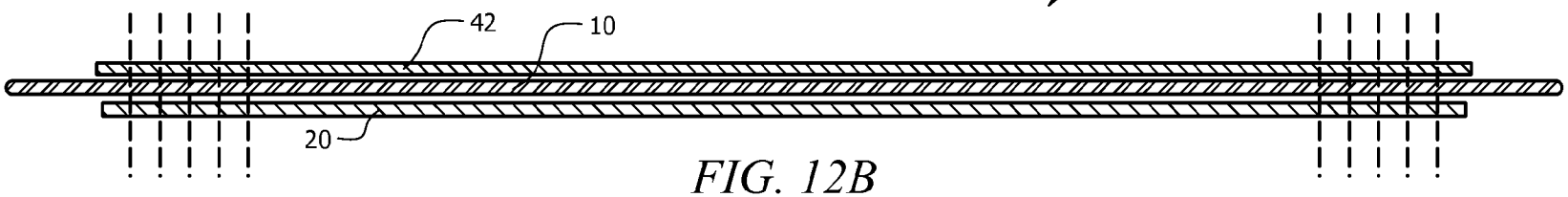

Another embodiment of the handhold is depicted in FIGS. 12A-12B. The simple two-layer handhold 1200 is constructed of a piece of flexible material 44 and a piece of flexible binding material 52. The piece of flexible material 44 is cut slightly thinner in width than the flexible binding material 52 and the piece of flexible material 44 is layered on top of the flexible binding material 52. The edges of the flexible binding material 52 are wrapped over the edges flexible material piece 44 and tacked or solidly sewn along the length. The assembled handhold 1200 is then attached to the garment by sewing both ends of the handhold 1200 with stitches that penetrate through the clothing structure 10 and the hidden harness 20.

Figure 13A:
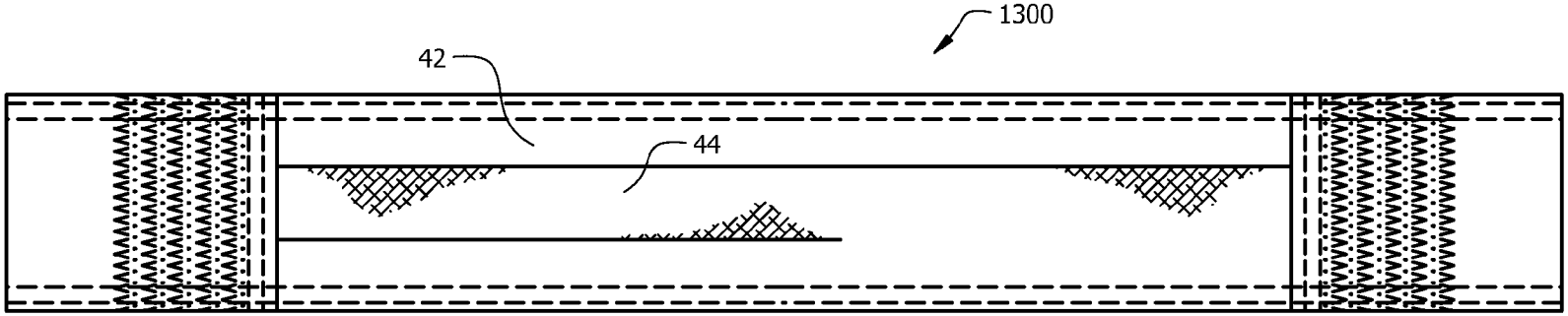
Figure 13B:
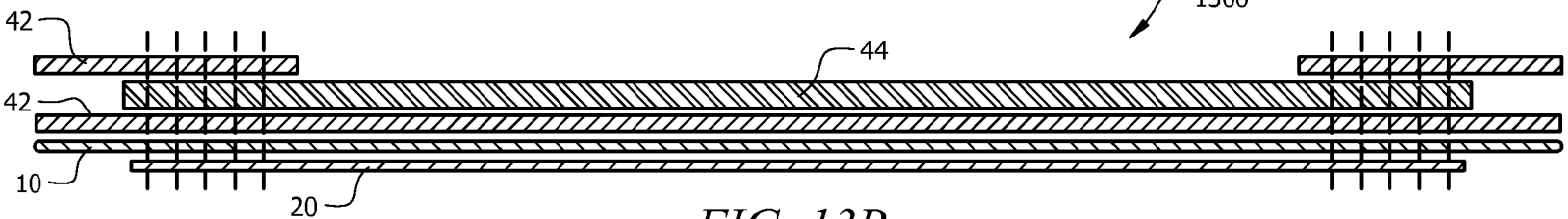

Another embodiment of the handhold is depicted in FIGS. 13A-13B. The centerline handhold 1300 is constructed of one piece of rigid material 42 and one piece of flexible material 44. The flexible material 44 is cut thinner in with and layered on top of the rigid material 42. The flexible material 44 is tacked or sewn along its edges to the rigid material 42. The ends of the rigid material 42 are folded over the exposed ends of the flexible material 44 so that they are encased and then tacked or sewn at the edge of the overlap. The assembled handhold 1300 is then attached to the garment by sewing both ends of the handhold 1200 with stitches that penetrate through the clothing structure 10 and the hidden harness 20.

Figure 14A:
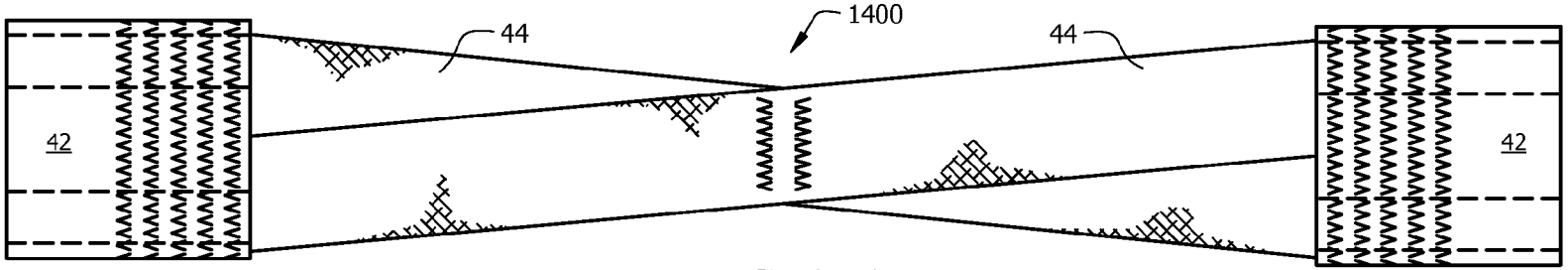
Figure 14B:
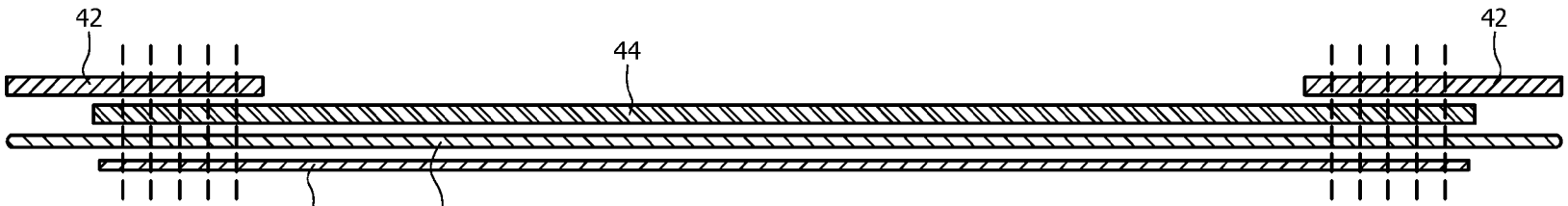

Another embodiment of the handhold is depicted in FIGS. 14A-14B. The crossing handhold 1400 is a four piece handhold constructed of two pieces of rigid material 42 and two pieces of flexible material 44. The two lengths of flexible material 44 are layered on top of one another in such a way that the centers of the flexible material 44 cross as shown in FIG. 14A. The pieces of flexible material 44 are tacked or sewn together at their crossing point. This assembly is then wrapped at both ends with the two pieces of rigid fabric 42. The rigid fabric 42 may either fold in the center and encase the loose ends of the flexible materials 44 fully or be a single piece that is sewn over the loose ends of the flexible fabrics 44. The assembled handhold 1400 is then attached to the garment by sewing both ends of the handhold 1200 with stitches that penetrate through the clothing structure 10 and the hidden harness 20.

Figure 15A:
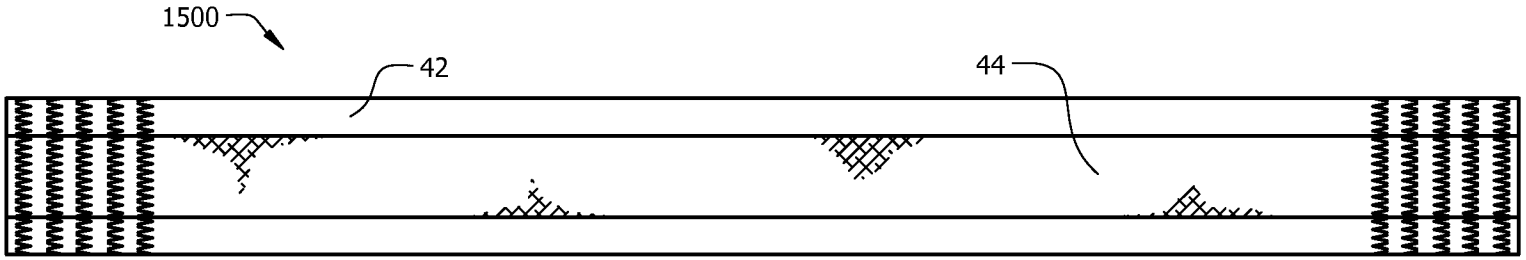
Figure 15B:
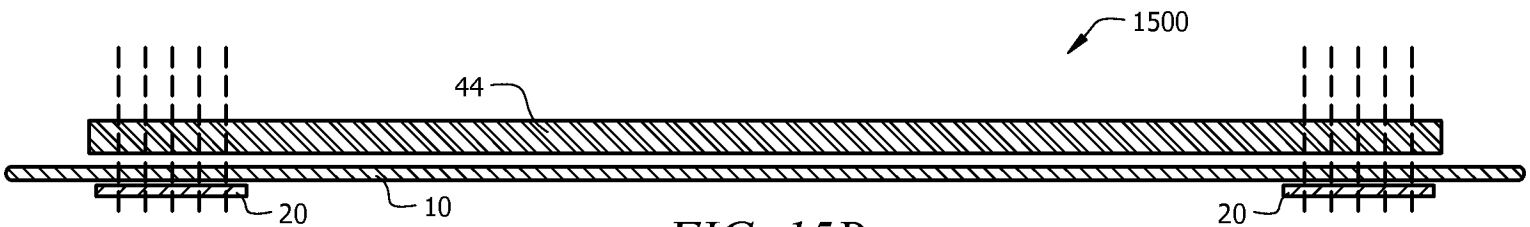

Another embodiment of the handhold is depicted in FIGS. 15A-15B. The threaded tube handhold 1500 is constructed of a flexible material 44 or bungee encased in a tube of rigid material 42 or tubular webbing. The tube of rigid material 42 may be formed by folding the piece of rigid fabric 42 lengthwise and sewing the edges together. The flexible material 44 may either be flat or tubular, and the flexible material 44 or bungee must have a width less than that of the rigid material tube 42 or tubular webbing. The flexible material 44 or bungee is threaded through the rigid material tube and may be tacked or sewn within the tube or left loose. The assembled handhold 1500 is then attached to the garment by sewing both ends of the handhold 1200 with stitches that penetrate through the clothing structure 10 and the hidden harness 20.

EXAMPLES

One embodiment of the invention is a rugby romper, a full body garment that covers a child's arms and legs completely. The rugby romper has a hidden harness and seven handholds. The harness is constructed of two main vertical straps that begin at the openings of the anterior leg portions, extend upward over the anterior torso portion, over the shoulder portions and down the posterior torso portion, terminating at the openings of the posterior leg portions. A pair of horizontal support straps extend from the main vertical straps in the shoulder portions down each sleeve portion. A pair of horizontal support straps connect the anterior and posterior extensions of the main vertical straps by encircling the leg portion about two inches below where the child's knee would be located. Terminal support straps encircle each opening of the sleeve and leg portions. There is a pair of anterior sleeve vertical (shoulder) handholds, an anterior torso (chest) handhold, a posterior torso (upper back) handhold with the tether attachment variation, an inferior posterior torso (lower back) handhold and a pair of posterior leg vertical (calf) handholds.

Another embodiment of the invention is overalls, a full body garment with adjustable over-the-shoulder straps with a hidden harness and seven handholds. The harness is constructed of two main vertical straps that begin at the openings of the anterior leg portions, extend upward over the anterior torso portion, over the shoulder portions and down the posterior torso portion, terminating at the openings of the posterior leg portions. These main vertical straps are incorporated into the overall straps. A pair of horizontal support straps connect the anterior and posterior extensions of the main vertical straps by encircling the leg portion about two inches below where the child's knee would be located. Terminal support straps encircle each opening of the leg portions. There is a pair of superior torso transitional (over the shoulder) handholds as they reinforce the overall's natural straps, an anterior torso (chest) handhold, a posterior torso (upper back) handhold with the tether attachment variation, an inferior posterior torso (lower back) handhold and a pair of lateral leg vertical (side leg) handholds.

Another embodiment of the invention is pants, a lower body garment with a hidden harness and seven handholds. The pants have four main vertical straps that begin at the openings of the leg portions in the anterior and posterior and extend upward to the upper hem of the garment. A horizontal support strap encircles the upper hem, reinforcing the natural waistline of the pants. A pair of horizontal support straps connect the anterior and posterior extensions of the main vertical straps by encircling the leg portion about two inches below where the child's knee would be located. Terminal support straps encircle each opening of the sleeve and leg portions. There is a pair of lateral leg vertical (side leg) handholds, an inferior posterior torso (lower back) handhold, and a pair of posterior leg vertical (calf) handholds.

Another embodiment of the invention is a jacket, an upper body garment with a hidden harness and seven handholds. The harness is constructed of two main vertical straps that begin at the lower hem of the anterior torso portion, extend upward over the anterior torso portion, over the shoulder portions and down the posterior torso portion, terminating at the lower hem of the posterior torso portion. A pair of horizontal support straps extend from the main vertical straps in the shoulder portions down each sleeve portion. Terminal support straps encircle each opening of the sleeve portions. A horizontal support strap extends across the upper posterior torso portion from one main vertical strap to the other. There is a pair of lateral torso transitional (side hip) handholds, a posterior torso (mid-back) handhold with tether attachment variations, a posterior head horizontal (top side hood) handhold and a pair of lateral sleeve vertical (lower arm) handholds.

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A garment for children comprising:

a. a clothing structure, wherein said clothing structure is a full body clothing structure comprising a torso portion, a left shoulder portion, a right shoulder portion, a neck portion between said left and right shoulder portions, a left leg portion and a right leg portion, each of said left and right leg portions having an opening terminal from said torso portion, wherein each of said portions has an anterior side and posterior side;

b. a hidden harness attached to said clothing structure, said harness comprising:

i. a left main vertical strap, wherein said left main vertical strap extends from said opening of said left anterior leg portion upward along said anterior torso portion, over said left shoulder portion, and downward along said posterior torso portion to said opening of said left posterior leg portion;

ii. a right main vertical strap, wherein said right main vertical strap extends from said opening of said right anterior leg portion upward along said anterior torso portion, over said right shoulder portion, and downward along said posterior torso portion to said opening of said right posterior leg portion;

iii. a first horizontal support strap across said upper posterior torso portion, wherein said first horizontal support strap is attached to said left and right main vertical straps;

iv. a left leg horizontal support strap, wherein said left leg horizontal support strap encircles said left leg portion and is attached to said left main vertical strap where said left leg horizontal support strap intersects said left main vertical strap in the anterior and posterior of said left leg portion;

v. a right leg horizontal support strap, wherein said right leg horizontal support strap encircles said right leg portion and is attached to said right main vertical strap where said right leg horizontal support strap intersects said right main vertical strap in the anterior and posterior of said right leg portion;

vi. a left leg terminal support strap, wherein said left leg terminal support strap encircles said opening of said left leg portion and is attached to said left main vertical strap where said left leg terminal support strap intersects said left main vertical strap in the anterior and posterior of said left leg portion; and vii. a right leg terminal support strap, wherein said right leg terminal support strap encircles said opening of said right leg portion and is attached to said right main vertical strap where said right leg terminal support strap intersects said right main vertical strap in the anterior and posterior of said right leg portion; and c. at least four exterior handholds attached to said clothing structure and said hidden harness.

2. The garment of claim 1 further comprising:

a. a first exterior handhold extending across the upper anterior torso portion of said clothing structure from said left main vertical strap to said right main vertical strap, said first exterior handhold attached to said clothing structure and said left and right main vertical straps;

b. a second exterior handhold extending across the upper posterior torso portion of said clothing structure from said left main vertical strap to said right main vertical strap, said second exterior handhold attached to said clothing structure and said left and right main vertical straps;

c. a third exterior handhold extending across the lower posterior torso portion of said clothing structure from said left main vertical strap to said right main vertical strap, said third exterior handhold attached to said clothing structure and said left and right main vertical straps;

d. a left leg exterior handhold extending along the lateral left leg portion from said left leg horizontal support strap to said left leg terminal support strap, said left leg exterior handhold attached to said clothing structure, said left leg horizontal support strap, and said left leg terminal support strap; and e. a right leg exterior handhold extending along the lateral right leg portion from said right leg horizontal support strap to said right leg terminal support strap, said right leg exterior handhold attached to said clothing structure, said right leg horizontal support strap, and said right leg terminal support strap.

3. The garment of claim 2 wherein said clothing structure further comprises a left sleeve portion and a right sleeve portion, each of said left and right sleeve portions having an opening terminal from said shoulder portions.

4. The garment of claim 3 wherein said hidden harness further comprises:

a. a left sleeve horizontal support strap extending from said left main vertical strap in said left shoulder portion to said opening of said left sleeve portion;

b. a right sleeve horizontal support strap extending from said right main vertical strap in said right shoulder portion to said opening of said right sleeve portion;

c. a left sleeve terminal support strap, wherein said left sleeve terminal support strap encircles said opening of said left sleeve portion and is attached to said left sleeve horizontal support strap; and d. a right sleeve terminal support strap, wherein said right sleeve terminal support strap encircles said opening of said right sleeve portion and is attached to said right sleeve horizontal support strap.

5. The garment of claim 4 further comprising:

a. a left sleeve exterior handhold extending along the lateral left sleeve portion from said left main vertical strap to a point on said left sleeve horizontal strap, said left sleeve exterior handhold attached to said clothing structure, said left main vertical strap, and said left sleeve horizontal support strap; and b. a right sleeve exterior handhold extending along the lateral right sleeve portion from said right main vertical strap to a point on said right sleeve horizontal strap, said right sleeve exterior handhold attached to said clothing structure, said right main vertical strap, and said right sleeve horizontal support strap.

6. The garment of claim 1 further comprising a horizontal support strap across said upper posterior torso portion, lower posterior torso portion, upper anterior torso portion, or lower anterior torso portion wherein said horizontal support strap is attached to said left and right main vertical straps.

7. A garment for children comprising:

a. a clothing structure, wherein said clothing structure is an upper body clothing structure comprising a torso portion terminating in a lower hem, a left shoulder portion, a right shoulder portion, a neck portion between said left and right shoulder portions, a left sleeve portion and a right sleeve portion, each of said left and right sleeve portions having an opening terminal from said shoulder portions, wherein each of said portions has an anterior side and posterior side;

b. a hidden harness attached to said clothing structure, said harness comprising:

i. a left main vertical strap, wherein said left main vertical strap extends from said lower hem of said anterior torso portion upward along said anterior torso portion, over said left shoulder portion, and downward along said posterior torso portion to said lower hem of said posterior torso portion;

ii. a right main vertical strap, wherein said right main vertical strap extends from said lower hem of said anterior torso portion upward along said anterior torso portion, over said right shoulder portion, and downward along said posterior torso portion to said lower hem of said posterior torso portion;

iii. a first horizontal support strap across said upper posterior torso portion, wherein said first horizontal support strap is attached to said left and right main vertical straps;

iv. a second horizontal support strap encircling said lower hem of said torso portion, said second horizontal strap attached to said left and right main vertical straps where said second horizontal straps intersects said left and right main vertical straps;

v. a left sleeve horizontal support strap extending from said left main vertical strap in said left shoulder portion to said opening of said left sleeve portion;

vi. a right sleeve horizontal support strap extending from said right main vertical strap in said right shoulder portion to said opening of said right sleeve portion;

vii. a left sleeve terminal support strap, wherein said left sleeve terminal support strap encircles said opening of said left sleeve portion and is attached to said left sleeve horizontal support strap; and viii. a right sleeve terminal support strap, wherein said right sleeve terminal support strap encircles said opening of said right sleeve portion and is attached to said right sleeve horizontal support strap; and c. at least four exterior handholds attached to said clothing structure and said hidden harness.

8. The garment of claim 7 further comprising:

a. a first exterior handhold extending across the upper posterior torso portion of said clothing structure from said left main vertical strap to said right main vertical strap, said second exterior handhold attached to said clothing structure and said left and right main vertical straps;

b. a second exterior handhold extending laterally from a point on the left side of said anterior lower hem to a point on the left side of said posterior lower hem, said second exterior handhold attached to said clothing structure and said second horizontal strap;

c. a third exterior handhold extending laterally from a point on the right side of said anterior lower hem to a point on the right side of said posterior lower hem, said third exterior handhold attached to said clothing structure and said second horizontal strap;

d. a left sleeve exterior handhold extending along the lateral left sleeve portion from said left main vertical strap to a point on said left sleeve horizontal strap, said left sleeve exterior handhold attached to said clothing structure, said left main vertical strap, and said left sleeve horizontal support strap; and e. a right sleeve exterior handhold extending along the lateral right sleeve portion from said right main vertical strap to a point on said right sleeve horizontal strap, said right sleeve exterior handhold attached to said clothing structure, said right main vertical strap, and said right sleeve horizontal support strap.

9. The garment of claim 7 further comprising a horizontal support strap across said upper posterior torso portion, lower posterior torso portion, upper anterior torso portion, or lower anterior torso portion wherein said horizontal support strap is attached to said left and right main vertical straps.

10. A garment for children comprising:

a. a clothing structure, wherein said clothing structure is a lower body clothing structure comprising a torso portion terminating in an upper hem, a left leg portion and a right leg portion, each of said left and right leg portions having an opening terminal from said torso portion, wherein each of said portions has an anterior side and posterior side;

b. a hidden harness attached to said clothing structure, said harness comprising:

i. an anterior left main vertical strap, wherein said anterior left main vertical strap extends from said upper hem of said anterior left torso portion downward to said opening of said anterior left leg portion;

ii. an anterior right main vertical strap, wherein said anterior right main vertical strap extends from said upper hem of said anterior right torso portion downward to said opening of said anterior right leg portion;

iii. a posterior left main vertical strap, wherein said posterior left main vertical strap extends from said upper hem of said posterior left torso portion downward to said opening of said posterior left leg portion;

iv. a posterior right main vertical strap, wherein said posterior right main vertical strap extends from said upper hem of said posterior right torso portion downward to said opening of said posterior right leg portion;

v. a first horizontal support strap encircling said upper hem of said torso portion, said first horizontal strap attached to said main vertical straps where said first horizontal straps intersects said anterior left, anterior right, posterior left and posterior right main vertical straps;

vi. a left leg horizontal support strap, wherein said left leg horizontal support strap encircles said left leg portion and is attached to said anterior left and posterior leg main vertical straps where said left leg horizontal support strap intersects said anterior and posterior left main vertical straps;

vii. a right leg horizontal support strap, wherein said right leg horizontal support strap encircles said right leg portion and is attached to said anterior and posterior right main vertical straps where said right leg horizontal support strap intersects said anterior and posterior right main vertical straps;

viii. a left leg terminal support strap, wherein said left leg terminal support strap encircles said opening of said left leg portion and is attached to said anterior and posterior left main vertical straps where said left leg horizontal support strap intersects said anterior and posterior left main vertical straps; and ix. a right leg terminal support strap, wherein said right leg terminal support strap encircles said opening of said right leg portion and is attached to said anterior and posterior right main vertical straps where said right leg horizontal support strap intersects said anterior and posterior right main vertical straps; and c. at least four exterior handholds attached to said clothing structure and said hidden harness.

11. The garment of claim 10 further comprising:

a. a first exterior handhold extending across the upper posterior torso portion of said clothing structure from said posterior left main vertical strap to said posterior right main vertical strap, said first exterior handhold attached to said clothing structure and said posterior left and posterior right main vertical straps;

b. a left leg transitional exterior handhold extending along the lateral left leg portion from said anterior left main vertical support strap to said posterior left main vertical support strap, said left leg transitional exterior handhold attached to said clothing structure, said left leg horizontal support strap, said anterior left main vertical support strap, and said posterior left main vertical support strap;

c. a right leg transitional exterior handhold extending along the lateral right leg portion from said anterior right main vertical support strap to said posterior right main vertical support strap, said right leg transitional exterior handhold attached to said clothing structure, said right leg horizontal support strap, said anterior right main vertical support strap, and said posterior right main vertical support strap;

d. a left leg posterior external handhold extending from a point on said posterior left main vertical strap to said left leg terminal support strap, said left leg posterior external handhold attached to said clothing structure, said posterior left main vertical strap and said left leg terminal support strap; and e. a right leg posterior external handhold extending from a point on said posterior right main vertical strap to said right leg terminal support strap, said right leg posterior external handhold attached to said clothing structure, said posterior right main vertical strap and said right leg terminal support strap.

12. The garment of claim 3 wherein said hidden harness further comprises:

a. a left main vertical strap, wherein said left main vertical strap extends from said opening of said anterior left leg portion upward along said anterior torso portion, over said left shoulder portion, and downward along said posterior torso portion to said opening of said posterior left leg portion;

b. a right main vertical strap, wherein said right main vertical strap extends from said opening of said anterior right leg portion upward along said anterior torso portion, over said right shoulder portion, and downward along said posterior torso portion to said opening of said posterior right leg portion;

c. a left sleeve horizontal support strap extending from said left main vertical strap in said left shoulder portion to said opening of said left sleeve portion;

d. a right sleeve horizontal support strap extending from said right main vertical strap in said right shoulder portion to said opening of said right sleeve portion;

e. a left sleeve terminal support strap, wherein said left sleeve terminal support strap encircles said opening of said left sleeve portion and is attached to said left sleeve horizontal support strap;

f. a right sleeve terminal support strap, wherein said right sleeve terminal support strap encircles said opening of said right sleeve portion and is attached to said right sleeve horizontal support strap; and g. a left leg terminal support strap, wherein said left leg terminal support strap encircles said opening of said left leg portion and is attached to said left main vertical strap where said left leg terminal support strap intersects said left main vertical strap in the anterior and posterior of said left leg portion; and h. a right leg terminal support strap, wherein said right leg terminal support strap encircles said opening of said right leg portion and is attached to said right main vertical strap where said right leg terminal support strap intersects said right main vertical strap in the anterior and posterior of said right leg portion.

13. The garment of claim 12 further comprising a horizontal support strap across said upper posterior torso portion, lower posterior torso portion, upper anterior torso portion, or lower anterior torso portion wherein said horizontal support strap is attached to said left and right main vertical straps.

14. The garment of claim 1 wherein said exterior handholds are selected from the group consisting of superior anterior handhold, anterior torso handhold, inferior anterior torso handhold, anterior sleeve vertical handhold, superior posterior torso handhold, posterior torso handhold, inferior posterior torso handhold, posterior sleeve vertical handhold, superior torso transitional handhold, lateral torso transitional handhold, anterior sleeve horizontal/diagonal handhold, anterior leg horizontal/diagonal handhold, anterior leg vertical handhold, posterior sleeve horizontal/diagonal handhold, posterior leg horizontal/diagonal handhold, or posterior leg vertical handhold.

15. The garment of claim 7 wherein said exterior handholds are selected from the group consisting of superior anterior handhold, anterior torso handhold, inferior anterior torso handhold, anterior sleeve vertical handhold, superior posterior torso handhold, posterior torso handhold, inferior posterior torso handhold, posterior sleeve vertical handhold, superior torso transitional handhold, lateral torso transitional handhold, anterior sleeve horizontal/diagonal handhold, anterior leg horizontal/diagonal handhold, anterior leg vertical handhold, posterior sleeve horizontal/diagonal handhold, posterior leg horizontal/diagonal handhold, or posterior leg vertical handhold.

16. The garment of claim 10 wherein said exterior handholds are selected from the group consisting of superior anterior handhold, anterior torso handhold, inferior anterior torso handhold, anterior sleeve vertical handhold, superior posterior torso handhold, posterior torso handhold, inferior posterior torso handhold, posterior sleeve vertical handhold, superior torso transitional handhold, lateral torso transitional handhold, anterior sleeve horizontal/diagonal handhold, anterior leg horizontal/diagonal handhold, anterior leg vertical handhold, posterior sleeve horizontal/diagonal handhold, posterior leg horizontal/diagonal handhold, or posterior leg vertical handhold.

* * * * *